US005193865A

United States Patent [19]

Allenbaugh

[11] Patent Number: 5,193,865

[45] Date of Patent: Mar. 16, 1993

[54] SLIDING DOOR BAR LOCK

[75] Inventor: Howard M. Allenbaugh, Huntington Beach, Calif.

[73] Assignee: M.A.G. Eng. & Mfg. Inc., Huntington Beach, Calif.

[21] Appl. No.: 741,761

[22] Filed: Aug. 7, 1991

[51] Int. Cl.[5] ..... E05C 17/34

[52] U.S. Cl. ..... 292/262; 292/DIG. 46; 292/263; 292/341.17; 292/238

[58] Field of Search ..... 292/262, DIG. 46, 338, 292/259, 341.17, 263, 278, 304, 104, 136, 108, 210, 238

[56] References Cited

U.S. PATENT DOCUMENTS

| | | | |
|---|---|---|---|
| 321,964 | 7/1885 | Griffin | 292/136 |
| 672,736 | 4/1901 | Jewett | 292/108 |
| 778,312 | 12/1904 | Hall | 292/108 X |
| 880,318 | 2/1908 | Mattox | 292/108 |
| 1,921,189 | 8/1933 | Jensen | 292/104 |
| 2,340,864 | 2/1944 | Carpenter | 292/108 X |
| 2,510,303 | 6/1950 | Williamette | 292/263 |
| 3,328,920 | 7/1967 | Cohen et al. | 49/449 |
| 3,993,336 | 11/1976 | Frost | 292/263 |
| 4,135,376 | 1/1979 | Evans et al. | 70/100 |
| 4,248,461 | 2/1981 | Stevens | 292/218 |
| 4,314,721 | 2/1982 | Clark | 292/DIG. 46 |
| 4,461,502 | 7/1984 | Burgess | 292/262 |
| 4,493,501 | 1/1985 | Abel | 292/DIG. 46 X |
| 4,530,531 | 7/1985 | Mantini | 292/DIG. 46 X |
| 4,570,985 | 2/1986 | Waldo et al. | 292/262 |
| 4,674,779 | 6/1987 | Pratt | 292/263 |
| 4,699,407 | 10/1987 | Fortier | 292/263 |
| 4,792,168 | 12/1988 | Kardosh | 292/288 |
| 4,971,374 | 11/1990 | Lovell et al. | 292/339 |

*Primary Examiner*—Richard E. Moore
*Attorney, Agent, or Firm*—Pretty, Schroeder, Brueggemann & Clark

[57] ABSTRACT

A locking device for securing a sliding door in either a fully closed or partially opened, vented position. The device comprises an elongated bar having one end pivotally attached to the door frame and a free end with a specially shaped recess adapted to engage a lock assembly connected to the door. The lock assembly includes a rotatable shaft having a substantially rectangular cross-section for locking engagement with the bar's recess. Rotation of the shaft between locked and unlocked positions respectively locks and unlocks the bar to the lock assembly. The free end of the bar also may have a folding vent link having a similar specially shaped recess that may be used for venting of the door, while still securing it to prevent unwanted entry.

9 Claims, 2 Drawing Sheets

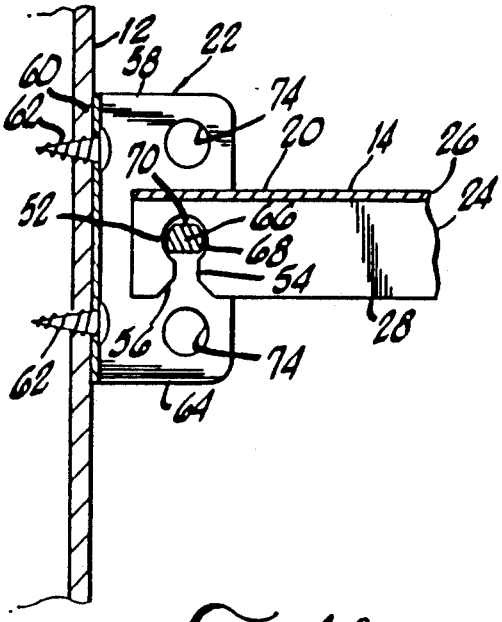
FIG. 4A.
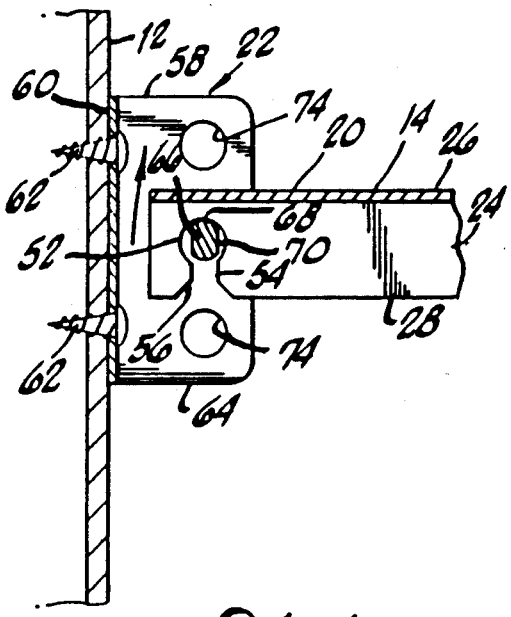
FIG. 4B.
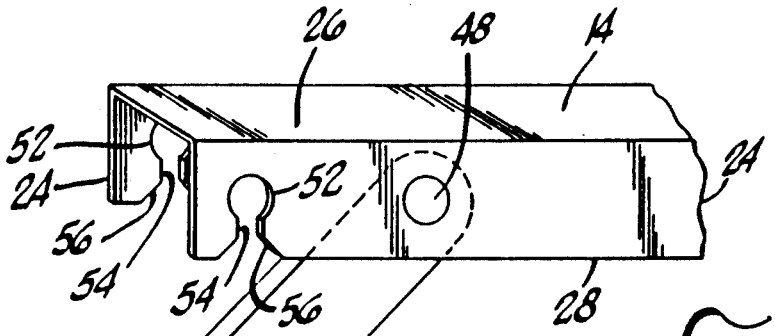
FIG. 5.
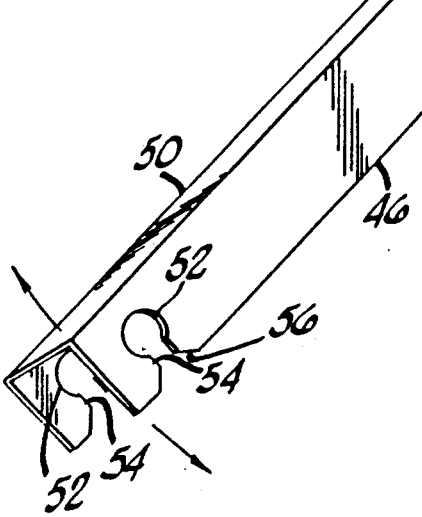
FIG. 6.
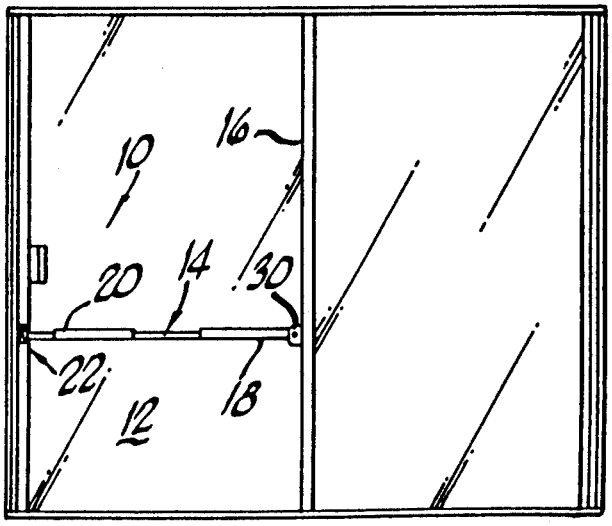

SLIDING DOOR BAR LOCK

BACKGROUND OF THE INVENTION

The present invention relates to devices for securing sliding doors and the like in a fully closed or partially opened, vented position.

One simple and common type of device for locking sliding doors comprises a relatively long and narrow bar of metal, wood or plastic loosely disposed in the bottom channel of the sliding door frame, between the sliding door and a vertical frame member at the back of the door, so as to block the sliding movement of the door. The length of the bar is usually selected either to secure the door in a fully locked position, or to permit venting by allowing the door to be opened slightly before it encounters and is stopped by the bar. Some devices of this type have extensions which allow them to secure a door in either a fully closed or partially open, vented position.

However, devices of the type described above are not without their problems. For example, these devices are designed to stop the door by a bracing force applied against the bottom of the door. As a result, the door can sometimes be jarred and lifted over the device. Moreover, since such devices are not normally attached to either the door or the frame, they can sometimes be easily dislodged from the bottom channel of the door frame in which they rest, particularly when the door is opened for venting purposes.

In an attempt to solve some of these problems, special devices for securing sliding doors have been designed specifically for this purpose. Such devices generally comprise elongated bars having one end hingedly attached to a vertical member of the door frame, above the bottom frame channel, at a point approximately half way up that member. To secure the door, the bar is pivoted to a horizontal position so that the free, unhinged end of the bar is in abutting contact with the sliding door. To unsecure the door, the bar is pivoted out of the way into a vertical position in which it is aligned with and substantially against the vertical door frame member. Some pivoting bars have a main portion sized to secure the door in a partially opened position for venting purposes, with an extension which when deployed allows the extended bar to secure the sliding door in a fully closed position.

While the pivoting bars described above normally have one end hingedly attached to a vertical member of the door frame, the free end in some instances is held against the sliding door solely by friction, or supported (but not secured) by a U-shaped cradle. Both of these arrangements are unsatisfactory because they tend to permit the free end of the bar to slip, be dislodged or lifted out of its cradle. Even the few commercially available security devices of this type, with provisions for locking the free end of the bar to the sliding door, tend to be costly, difficult to install and inconvenient to use, as they usually require a key.

The security problems that arise from the above situation are particularly acute when the door is partially opened for venting purposes. Although the vent opening is typically too narrow for even a small child to pass through, it is usually sufficiently wide for someone to introduce a pole or other elongated implement for the purpose of dislodging the bar from either the bottom of the sliding door channel or from the cradle supporting the free end of the bar. Therefore, a significant disadvantage of existing bar-type devices for securing sliding doors and the like is that they are either fairly easily overridden and dislodged, or they are too elaborate, costly, and inconvenient to use.

Another significant security problem exists when the sliding door slides on the outside with respect to the door frame. While the devices described above have some utility on sliding doors that slide inside with respect to the door frame, they generally do not work well or at all on outside sliding doors.

From the foregoing, it should be apparent that a need exists for a simple, inexpensive device which is easy to install and use, for securing sliding doors and the like, whether or not they slide on the inside or the outside, and which will keep the bar in place when the sliding door is either fully locked or partially opened for venting purposes. The present invention satisfies this need and provides further related advantages.

SUMMARY OF THE INVENTION

The present invention provides a locking device for securing a sliding door of the like with respect to a door frame. The device comprises a locking assembly mounted on the door for movement between a locked position and an unlocked position, and an elongated bar having one end pivotally connected to the door frame and a free end having a specially shaped recess adapted to engage with and disengage from the locking assembly. Movement of the locking assembly to the locked position, when engaged with the recess of the bar, securely locks the free end of the bar to the door. On the other hand, movement of the locking assembly to the unlocked position enables free engagement or disengagement of the free end of the bar with respect to the locking assembly.

In one aspect of the invention, the locking assembly comprises a U-shaped bracket having a mounting surface for mounting the bracket to the door. The bracket also has two substantially parallel, spaced plates connected to the mounting surface of the bracket. A shaft is mounted for rotation between the two parallel plates and has a substantially rectangular cross-section, comprising diametrically opposed short sides defining a first thickness and two diametrically opposed long sides defining a second thickness that is less than the first thickness.

The free end of the bar includes an entrance opening leading to the recess and is configured so that the entrance opening has a width that is less than the first, larger thickness of the shaft, but is greater than its second, smaller thickness. The recess preferably is circular in shape and has a width or diameter that is greater than the first, larger thickness. As explained below, the shaft is rotatable to an unlocked position, in which the long sides of the shaft are oriented in a vertical direction, and a locked position, which the long sides of the shaft are oriented in a horizontal direction.

In operation, the shaft is adapted to fit through the entrance opening and into the recess of the bar when the shaft is in the unlocked position, in which the long sides of the shaft are oriented in a vertical direction. This permits free engagement and disengagement of the bar with respect to the locking mechanism, i.e., the shaft, since the shaft can pass freely through the entrance opening and into and out of the recess. However, when the shaft is in the locked position within the recess, with the long sides of the shaft oriented in a horizontal direction, the shaft will be securely retained within the recess of the bar. This securely locks the free end of the bar to the door, since the shaft cannot pass out of the recess through the entrance opening.

In another aspect of the invention, the shaft includes a turning handle connected to the shaft in such a way that the weight of the turning handle causes the shaft to normally be in a locked position. In this way, it is necessary to physically turn the handle 90 degrees, so that the shaft is in the unlocked position, before it is possible to disengage the bar from the locking assembly. Thus, the bar will be normally locked to the door to prevent unwanted entry unless the handle is physically turned, as described above.

In still another aspect of the invention, the free end of the bar is provided with a vent link having one end pivotally attached to the free end of the bar and a free end having a specially shaped recess of the type described above for connection to the locking assembly. When the vent link is in the extended position, the door will normally be fully closed and in a secured condition, with the recess of the vent link connected to the shaft of the locking assembly. However, when the vent link is folded or retracted, the door will normally be slightly opened for venting purposes and in a locked condition, with the recess on the free end of the bar engaged with the shaft of the locking assembly.

The locking device of this invention also is well-suited for use on sliding doors that slide on either the inside or the outside with respect to the door frame. In this aspect of the invention, the parallel side plates of the U-shaped mounting bracket have holes to allow the locking assembly to be mounted to the side surface of an outside sliding door. Thus, the locking device of this invention has enhanced utility for securing sliding doors, whether or not they slide on the inside or the outside.

Other features and advantages of the present invention will become apparent from the following detailed description, taken in conjunction with the accompanying drawings, which illustrate, by way of example the principles of the invention.

BRIEF DESCRIPTION OF THE DRAWINGS

The accompanying drawings illustrate the invention. In such drawings:

FIG. 4A is a cross-sectional elevational view of the locking device shown in a locked position;

FIG. 4B is a cross-sectional elevational view, similar to FIG. 4A, showing the locking device in an unlocked position;

FIG. 5 is a perspective view of a portion of the locking device, showing a pivotable link used for venting the locked door; and FIG. 6 is an elevational view of a sliding door showing an alternative embodiment of the locking device of the present invention.

DETAILED DESCRIPTION OF THE PREFERRED EMBODIMENT

Figure 1:
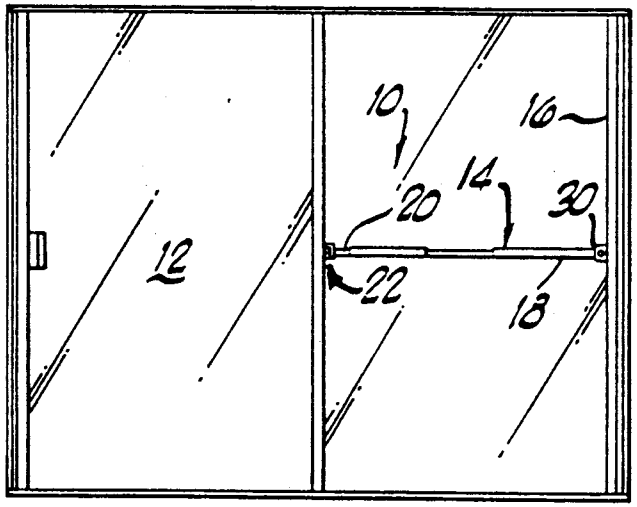
FIG. 1 is an elevational view of a sliding door secured by a locking device embodying the features of the present invention.

As shown in the exemplary drawings, the present invention is embodied in a locking device, generally referred to by the reference numeral 10, for securing a sliding door 12 or the like. As shown in FIG. 1, the device 10 comprises an elongated bar 14 positioned between the sliding door 12 and a door frame 16 within which the door slides. The bar 12 has a pivoting end 18 mounted for pivoting movement relative to a vertical member of the door frame 16 and a free end 20 which engages a lock assembly 22 mounted on a vertical surface of the sliding door 12. By this arrangement, the bar 14 can swing between a horizontal locked position, in which the free end 20 of the bar is engaged by the lock assembly 22, and a vertical unlocked position, in which the bar is pivoted alongside the door frame 16.

Figure 2:
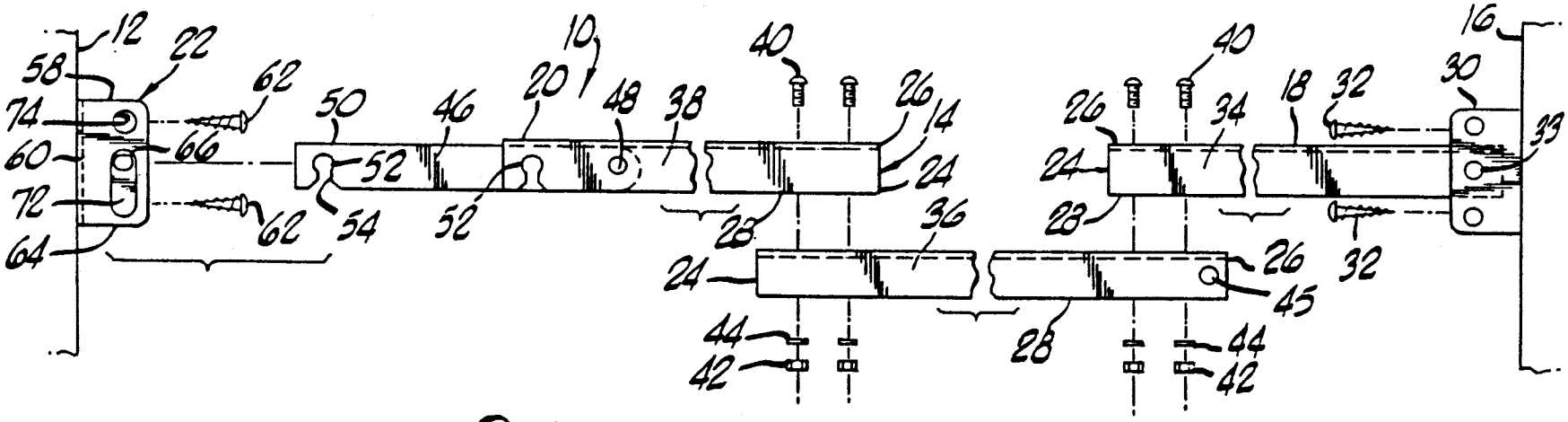
FIG. 2 is a exploded view showing the various components of the locking device prior to assembly.

FIGS. 2 and 5 shows a preferred embodiment of the locking device 10. In this embodiment, the bar 14 has a U-shaped cross-section, with two parallel side portions 24 extending at 90 degrees from a center portion 26. When the bar 14 is in the locked position (i.e. in a horizontal position), the "U" is inverted, with the center portion 26 facing the top of the door frame 16 and the edges 28 of the two side portions 24 and facing the bottom of the door frame. The pivoting end 18 of the bar 14 is pivotally attached to the vertical, stationary member of the door frame 16 by a bracket 30 and screws 32, with a pivot pin 33 to hold the pivoting end 18 of the bar. This allows the bar 14 to pivot between the locked and unlocked positions described above.

The bar itself comprises three sections 34, 36 and 38 bolted together by screws 40, with nuts 42 and washers 44. This allows the length of the bar 14 to be adjusted to accommodate sliding doors having different widths. Hence, the bar 14 does not need to be cut to adjust its length for different sized doors. Another bar adjustment feature for unusually small-width doors is the provision of a pair of holes 45 at one end of the middle bar section 36 for engagement by the pivot pin 33 of the bracket 30. For such small-width doors, the first bar section 34 may be discarded, with only the other two bar sections 36 and 38 being used. This allows a wide range of adjustability of the bar 14 in terms of its length.

In one form of the invention, the free end 20 of the bar 14 also includes a vent link 46 pivotally attached by a pin 48 to the outer one 38 of the bar's three sections As shown best in FIGS. 2 and 5, the vent link 46 can fold into the bar 14 or extend outwardly. As described in more detail below, the vent link 46 allows venting of the sliding door 12 while still keeping the door locked.

Both the free end 20 of the bar 14 and the free end 50 of the vent link 46 have identical circular apertures or recesses 52 formed in the parallel side portions 24 of the bar, with entrance openings 54 leading from the edges 28 of the side portions 24 to the recesses 52. These entrance openings 54 preferably have tapered surfaces 56 which are wider at the edges 28 of the side portions 24 than the diameter of the circular recess 52, while the entrance opening itself is narrower than the diameter of the circular recess. The recesses 52 in either the bar 14 or the vent link 46 are designed to engage the locking assembly 22 to conveniently lock and unlock the door 12.

The lock assembly 22 preferably is attached to a vertical surface on the door 12 and comprises a U-shaped bracket 58 having a mounting surface 60 for connection to the door by screws 62, and two spaced, parallel plates 64 extending at right angles to the mounting surface 60. A shaft 66 is mounted for rotation to the bracket 58 between the two plates 64. The shaft 66 has a substantially rectangular cross-section, with two diametrically opposed short sides 68 defining a first thickness and two diametrically opposed long sides 70 defining a second thickness that is less than the first thickness.

In accordance with the invention, the shaft 66 is rotatable between locked and unlocked positions for securing the bar 14 to the lock assembly 22. As shown in FIGS. 4A and 4B, locking and unlocking of the bar 14 with respect to the lock assembly 22 is enabled by cooperation between the shaft 66 and the recess 52 in either the bar 14 or the vent link 46. Thus, the entrance opening 54 to the bar 14 has a width that is less than the first, larger thickness between the short sides 68 of the shaft 66, but is greater than the second, smaller thickness between the long sides 70 of the shaft 66. The recess itself has a width or diameter that is greater than the greatest thickness of the shaft 66, which is the first thickness between the short sides 68 of the shaft. This sizing and configuration of the entrance opening 54 permits the shaft 66 to pass through the entrance opening and into the recess 52 only when the long sides 70 of the shaft are oriented in a vertical direction. However, when the long sides 70 of the shaft 66 are oriented in a horizontal direction, the shaft is retained within the recess 52 because it cannot pass into or out through the entrance opening 54.

With the foregoing arrangement, it will be appreciated that the shaft 66 is rotatable to a locked position, shown in FIG. 4A, in which the long sides 70 of the shaft 66 are oriented in a horizontal direction, and an unlocked position, shown in FIG. 4B, in which the long sides 70 of the shaft 66 are oriented in a vertical direction. In this way, the shaft 66 is adapted to be retained within the recess 52 of the bar 14 when the shaft is in the locked position, to thereby securely lock the free end 20 of the bar 14 to the door 12. However, when free engagement or disengagement of the bar 14 with respect to the locking assembly 22 is desired, the shaft 66 may be moved to the unlocked position so that it may fit through the entrance opening 54 as the bar 14 is pivoted away from the lock assembly 22 to a vertical position alongside the door frame 16.

Figure 3:
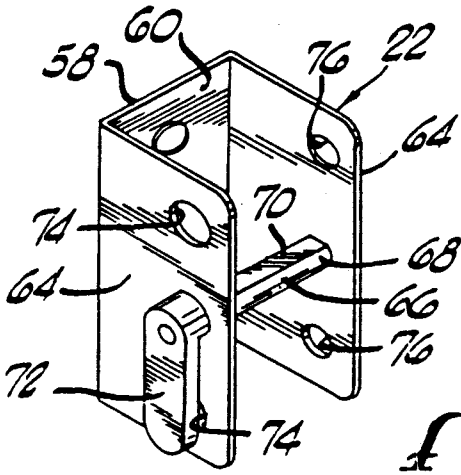
FIG. 3 is a perspective view of a lock assembly which forms a part of the locking device.

In one preferred form of the invention, the shaft 66 has a turning handle 72 connected to one end of the shaft 66. The turning handle 72 preferably is connected to the shaft 66 in such a way that the weight of the turning handle causes the shaft to normally be in the locked position, with the long sides 70 of the shaft 66 oriented in a horizontal direction, as shown in FIGS. 3 and 4A. This can be done, for example, by mounting the turning handle 72 to the end of the shaft 66 in an asymmetrical manner. Therefore, once the shaft 66 is within the recess 52, with the shaft in the locked position, it is necessary to manually rotate the turning handle 72 ninety degrees before the shaft can be in the unlocked position. Once the shaft 66 has passed into the recess 52, release of the turning handle 72 will cause the shaft to return to its normally locked position.

In the preferred embodiment, the bar 14, brackets 30 and 58, the shaft 68 and turning handle 72 are all made of steel, preferably cold rolled steel. The bar 14 and brackets 30 and 58 are best manufactured by a stamping process, while the shaft 68 and turning handle 72 are best manufactured by a die casting process. Other suitable materials and manufacturing techniques also may be used.

When the free end 20 of the bar 14 is equipped with the vent link 46, the door 12 advantageously can be spaced from the door frame 16 so that it assumes an open position for venting purposes. Thus, when the vent link 46 is folded or retracted with respect to the bar 14, the door 12 can be slightly opened for venting purposes and in a locked condition, with the recess 52 on the free end 20 of the bar 14 engaged with the shaft 66 of the locking assembly 22. However, when the vent link 46 is in the extended position, the door 12 will normally be fully closed and in a secured condition, with the recess 52 on the free end 50 of the vent link 46 connected to the shaft 66 of the locking assembly 22.

The embodiment of the invention described above may be used for sliding doors 12 that slide on the inside of a dwelling or other building with respect to the door frame 16. However, the locking device 10 of this invention also has equal utility on sliding doors that slide on the outside with respect to the frame. In this embodiment, shown in FIG. 6, the pivoting end 18 of the bar 14 is still mounted to the door frame 16 and the lock assembly 22 is still mounted to the door 12, but the U-shaped bracket 58 has holes 74 and 76 in the parallel plates 64, as shown best in FIG. 3, so that it can be mounted to the side of the door 12. The hole 74 is slightly larger than the hole 76 so that the shaft of a screwdriver or other tool may fit through the hole 74 and drive a screw through the hole 76 and into the door 12 to secure the bracket 58 and thus the lock assembly 22.

Regardless of whether the lock assembly 22 is secured to the door 12 by the mounting surface 60 for inside doors (FIG. 1) or by the holes 76 in the parallel plate 64 for outside doors (FIG. 6), a pad lock (not shown) or other device may be inserted through the top hole 74 to block the bar 14 from being removed from the lock assembly 22.

From the foregoing, it will be appreciated that the present invention provides a sliding door bar lock 10 which may conveniently swing between locked and unlocked positions and, when in a locked position, positively secures tee door 12 to the door frame 16 to prevent dislodgement of the bar 14 and unwanted entry. The device 10 also provides a convenient vent link 46 with the same locking features, to enable opening of the door 12 for venting purposes, while still maintaining a locked door. Moreover the device 10 can be used with equal utility and effectiveness for both inside and outside sliding doors.

While a particular form of the invention has been illustrated and described, it will be apparent that various modifications can be made without departing from the spirit and scope of the invention. Therefore, it is not intended that the invention be limited, except as by the appended claims.

I claim:

1. A locking device for securing a sliding door with respect to a door frame, comprising:

a locking mechanism comprising a shaft rotatably mounted to the door, wherein the shaft is rotatable between a locked position and an unlocked position;

an elongated bar having one end connected to the door frame and a free end having a recess adapted to engage with and disengage from the shaft, such that rotation of the shaft to the locked position when engaged with the recess of the bar securely locks the free end of the bar to the door, while rotation of the shaft to the unlocked position enables free engagement or disengagement of the free end of the bar with respect to the shaft; and a turning handle connected to the shaft in such a way that the weight of the turning handle causes the shaft to normally be in the locked position.

2. The locking device of claim 1, further comprising a U-shaped bracket having a mounting surface for mounting the bracket to the door and two substantially parallel, spaced plates connected to the mounting surface of the bracket, and wherein the shaft is mounted for rotation between the two plates.

3. The locking device of claim 2, wherein each of the plates on the bracket have mounting holes for mounting the bracket to the door such that either the mounting surface or one of the plates is mounted against the door.

4. The locking device of claim 3, further comprising locking means for restraining the bar from being lifted from the locking mechanism when the shaft is in the unlocked position.

5. The locking device of claim 1, further comprising a vent link having one end pivotally attached to the free end of the bar and a free end having a recess adapted to engage with and disengage from the shaft of the locking mechanism.

6. A locking device for securing a sliding door with respect to a door frame, comprising:

a locking mechanism mounted on the door for movement between a locked position and an unlocked position;

an elongated bar having one end connected to the door frame and a free end having a first recess adapted to engage with and disengage from the locking mechanism, such that movement of the locking mechanism to the locked position when engaged with the first recess of the bar securely locks the free end of the bar to the door, while movement of the locking mechanism to the unlocked position enables free engagement or disengagement of the free end of the bar with respect to the locking mechanism; and a vent link having one end pivotally attached to the free end of the bar and a free end having a second recess adapted to engage with and disengage from the locking mechanism.

7. The locking device of claim 6, wherein the locking mechanism comprises:

a U-shaped bracket having a mounting surface for mounting the bracket to the door and two substantially parallel, spaced plates connected to the mounting surface of the bracket; and a shaft mounted for rotation between the two plates, such that the shaft is rotatable between said locked position and said unlocked position.

8. The locking device of claim 7, further comprising a turning handle connected to the shaft in such a way that the weight of the turning handle causes the shaft to normally be in the locked position.

9. The locking device of claim 8, wherein the turning handle is mounted to the shaft in an asymmetrical manner.

* * * * *